United States Patent [19]

Fischer et al.

[11] Patent Number: 4,465,544

[45] Date of Patent: Aug. 14, 1984

[54] APPARATUS FOR PASTING A WEB AT RIGHT ANGLES TO ITS DIRECTION OF MOTION

[75] Inventors: Rudolph Fischer, Ludwigshafen-Oggersheim; Rudolf Stäb, Wachenheim, both of Fed. Rep. of Germany

[73] Assignee: Albert-Frankenthal AG, Frankenthal, Fed. Rep. of Germany

[21] Appl. No.: 472,727

[22] Filed: Mar. 7, 1983

[30] Foreign Application Priority Data

Mar. 3, 1982 [DE] Fed. Rep. of Germany ... 320762072

[51] Int. Cl.[3] ..... B05C 1/08

[52] U.S. Cl. ..... 156/548; 118/212; 118/216; 118/221; 118/240; 118/244; 118/219; 156/578

[58] Field of Search ..... 156/548, 578; 118/202, 118/211, 221, 216, 212, 244, 240, 259

[56] References Cited

U.S. PATENT DOCUMENTS

| | | | |
|---|---|---|---|
| 1,349,861 | 8/1920 | Stickney | 118/244 X |
| 3,640,244 | 2/1972 | Axelsson | 118/212 |
| 3,991,708 | 11/1976 | Huebschmann | 118/212 X |

*Primary Examiner*—David A. Simmons

[57] ABSTRACT

In connection with an apparatus for putting paste on a moving printed paper web in strips at a right angle to the direction of motion of the web by moving the web between a pasting cylinder and a web support part on the other side of the web, one purpose of the invention is to make certain that the strips of paste may be put on at a high speed and to have such a design that the upkeep work on the apparatus is simple and may be done quickly. To make this possible, the pasting cylinder is made up of cylinder body and a paster roll placed within it so that a limited area of its outer face is uncovered by an axial slot in the outer face of the body. The paster roll has one or more wells stretching along it that are topped up with paste at a point within the pasting cylinder body, while the parts of the outer face of the roll between the wells are stripped and kept clear of the paste. The paster roll and the pasting cylinder body supporting it are turned about two separate, parallel axes with the axis of the roll moving round the axis of the body. The speeds of turning of the roll and the body are such that the sum thereof is equal to the speed of the web. At the point at which the web is acted upon by the roll its opposite side is supported by the support part that is in the form of a rail placed eccentrically on a turning shaft, the shaft being run at such a speed that the surface speed of the rail is equal to the speed of the web.

17 Claims, 4 Drawing Figures

11
23
24
26
25
30
31
22
32
27
29
27
10
13
17
2a
20
19
16
18

11
8
2b
1
3
9
10
14
2
4
12
15
2a
7
6
5

APPARATUS FOR PASTING A WEB AT RIGHT ANGLES TO ITS DIRECTION OF MOTION

BACKGROUND OF THE INVENTION

The present invention is with respect to an apparatus for putting strips of paste on a moving web in a direction normal to the direction of motion of the web, and more specially to such an apparatus that is part of a machine for producing sections, that are made up of a number of folded products or sheets, that are joined together. The apparatus of the invention is more specially designed with a turning pasting cylinder with a pasting unit and a web support for use therewith.

Sections made by joining separate folded products together and in the form of tabloid or newspaper sections, have so far in the art been stapled with wire staples. However such staples make the section very much thicker and this gives a specially undesired effect with sections with only 8 or 12 pages inasfar as troubles are then likely when it later comes to stacking and packaging the sections.

SHORT OUTLINE OF THE INVENTION

It is for this reason that one purpose or object of the present invention is that of designing an apparatus making possible the fixing together of the separate folded products or sheets by right angle pasting, that is to say pasting in a direction normal to the direction of motion of the web.

While it is true that an earlier suggestion has been made in the German Auslegeschrift specification No. 1,133,232 in connection with a pasting apparatus of this form, the pasting cylinder in this earlier design was in the form of two arms that were placed on a driven shaft and which each had a pasting rail at their radially outer end, that had paste put on it by a roller dipping into a paste vessel. As a support roller for supporting the web on the other side of the web a bend roller was used round which the web was trained. Apparatus of this sort may only be used for generally low web speeds, and at high web speeds the pasting cylinder has to be run at such a high speed that it is likely that paste be flung off the said rails. A further point in addition to this is that such pasting rails in question only put on the paste in very wide strips, and on pressing the web on the parts of the rails having the paste, the paste may be squeezed out sideways, this not only giving a paste strip that is thicker at the edges but furthermore making the strip between the edges uneven. The operation of the system becomes even worse if the pasting rail is pushed into the surface of the dipping roller so that it is not only the radially outer faces of the pasting rails but furthermore the side parts next thereto that are covered in paste. As if this were not bad enough in itself, serious trouble conditions are then likely inasfar as the paste-wetted sides of the rails will take up paper dust so that the paste strips produced on the web will not have a neat or regular form. It may be seen from this that the system of the said German specification No. 1,133,232 is of hardly any value for pasting together folded products under working conditions likely in the trade.

For this reason one purpose of the invention is designing an apparatus that takes care of the shortcomings of prior art systems for putting paste on webs.

A further purpose or object of the invention is designing an apparatus of the sort noted that may be run without any trouble at web speeds of the same order as used in production of folded products and makes possible the pasting of the web along completely regular strips that are fully in keeping with the desired form and size.

A still further purpose of the invention is making such an apparatus that may be run at such speeds without any troubles caused by splashing of the paste or the taking up of paper dust or the like so that such system may more specially be used for the pasting together of the separate folded products or sheets to make up sections.

For effecting these and further purposes that will become clear on reading further parts of the present specification, in the invention the apparatus has the pasting cylinder in the form of a pasting cylinder body and at least one turning paster roll positioned thereon so as to be parallel to the axis thereof, said paster roll having at least one well to take up paste, means for putting paste on said roll, a doctor or stripper means acting on the said roll for producing a paste-free area thereof for touching the web on its way past the pasting cylinder. Furthermore the sum of the surface speed of the roller body, turning at a speed in keeping with the spacing to be produced between the strips of paste on the web and the speed of the paster roll that is turned in relation to the roller body, is equal to the web speed. The web support is in the form of a rail that is placed on a driven shaft and is parallel to the pasting cylinder.

Such a design is responsible for a form of the apparatus that, while being very simple, is at the same time trouble-free and efficient. One useful effect is that it is only the paste well or wells in the paster roll that take up paste, that is then taken up therefrom as the web is pushed against the roll by the web support. It is for this reason that the size of the paste strips put on the web thereby are quite the same as the size and form of the paste wells. The desired length and breadth of the paste strips may for this reason be fully controlled so as to be in complete agreement with size and form desired by the pressman or press engineer, the depth of the wells having some effect as well on the amount of paste put on. The relative motion between the paster roll and the pasting cylinder body makes it possible for the body to be designed only taking into account the mechanical loading of such parts. Even so however one may be certain of the paster roll and the web running completely in step without slip, something that fully puts an end to any smearing of the paste over the web. At the same time the fact that the paster roll is turned will make certain that the wells therein, when they have given up their paste to the web, may be filled up with paste again without needing any complex system for doing this. The doctoring or wiping effect on the paster roll is not only responsible for the wells being filled up with paste completely regularly but furthermore has the effect of more or less completely clearing and cleaning the face or the roll of paste so that there will be generally no building up of paper dust thereon, this greatly cutting down the amount of upkeep work on the apparatus. It will be seen that the joining together of the separate sheets of the sections by pasting in the invention makes the use of a stapler unnecessary so that the design of a folder may be made simpler and it will take up less space. At the same time as this there will no longer be a one sided thickening along one edge of the sections as caused by such stapling which in the past has been responsible for troubles in connection with the stacking and packaging of the sections.

As part of a useful development of the invention the paster roll may be taken up in a special hollow in the roller body so that it may be turned therein, said hollow being near the outer face of said roller body and opening out therethrough along a slot. Such a design makes certain of full support of the paster roll and the more or less complete covering over of its outer face having the paste wells, this further increasing the reliability and decreasing the amount of upkeep necessary.

A further useful possible development is that the paste well or wells have the form of grooves running in the axial direction and ending short of the narrowest web on which the apparatus is run. This makes certain that for makeready for a different web breadth no change in the pasting apparatus of the present invention will be necessary. Furthermore a paste strip, that may be in a single length or made up of more than one length placed end to end, may be used for sticking together sheets that have been cut from one broad web with such strips of paste.

As part of a further possible, and in fact preferred form of the invention, the stripper means may be in the form of a doctor or stripper shoe resting against the outer face of the paster roll and taken up in a shoe guide opening in the roller body so that it may be moved radially, the said doctor or stripper shoe having at least one paste pocket or paste storage space walled in and limited in part by an edging strip running round it, the pocket being able to be joined up with a paste supply system. With such a design one may be certain that the outer face of the paster roll is fully stripped of paste every time it is turned, while at the same time ruling out any chance of the parts of the edge strip fouling the paste well or wells. It is best for there to be a system, such as a compressed air system (that may be controlled while the apparatus is running) for keeping the shoe against the outer face of the paster roll.

Another outgrowth of the general teaching of the invention is to be seen in designing the rail of the web support, that is turned in step with the pasting cylinder, so that on its side which is nearest to the paster roll it has a pinch pad, that is turned with a surface speed the same as that of the web. The pinch pad or bolster is made of a soft elastic material. Such a design makes quite certain that the web is not strained or otherwise damaged, while nevertheless making certain that it is smoothly and fully cushioned while being pushed against by, or supported at, the outer face of the paster roll so that the web is able to take up the paste offered to it in the well or wells of said paster roll without any trouble conditions.

Further useful developments and outgrowths of the present invention will be seen from the account now to be given of one working example thereof using the figures herein.

LIST OF THE DIFFERENT VIEWS OF THE FIGURES

DETAILED ACCOUNT OF THE WORKING EXAMPLE OF THE INVENTION

Figures 1, 2:
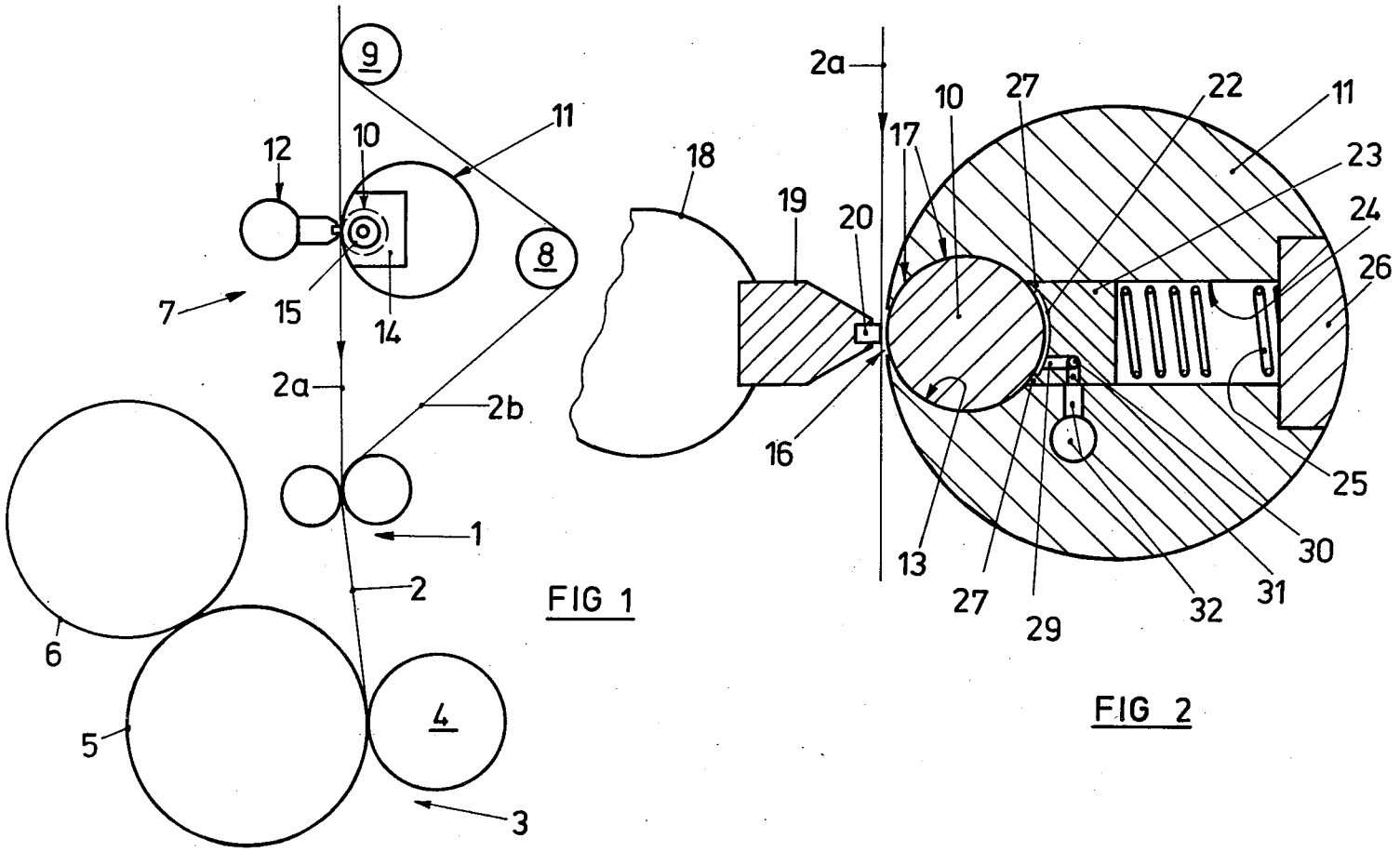
FIG. 1 is a view of a folder designed for producing eight-page sections, having the apparatus of the invention for pasting the web along strips running thereacross.
FIG. 2 is a view on a larger scale of the pasting apparatus, in the form of a radial section through the pasting cylinder and the web support used therewith.

Because the reader may be taken to have good working knowledge of the design of a folder, a detailed account thereof in the present connection is thought to be unnecessary, it only having to be pointed out that in FIG. 1 the web 2 may be seen to be moving downwards to cutting cylinder pins 1 by which it is gripped before moving on further down to the cutter generally numbered 3 for cutting crosswise into folded sheets. The folder 3 is made up of a cutting cylinder 4, whose knife is not to be seen in detail, and, working therewith, a folding cylinder 5 with pins and tucker blades (not to be seen in the figure), such blades forwarding, and at the same time folding, the cut sheets, that are kept in place on the cylinder by the pins, to the further cylinder 6 having folding jaws, the cylinder 6 being used with a delivery belt (not figured) running the sections to a fan wheel or the like. For producing an eight page section in the present case two ribbons of web 2 are needed that in the instant case are numbered **2*a* and 2*b***.

For joining together the separate sheets cut from the web 2 once they have been placed on top of each other, they are beforehand pasted along lines of the right angle folds as produced when the sheets are handed over from the cylinder 5 to the cylinder 6. To this end there is a pasting apparatus generally numbered 7 placed before, that is to say on the inlet side of, the cutter 3 and the cutting cylinder guide rolls 1, such pasting apparatus putting a right angle strip of paste on the inner side of one web ribbon—in the present case the web ribbon **2*a*—facing the other ribbon 2*b* of the web. Such strips of paste put on at a right angle to the length direction of the web are, after drying and/or curing responsible, for a strong join between the sheets as cut in the right angle cutter 3. The pasting apparatus 7 is run in register with the tucker knives of the cylinder 5 so that, in other words, the paste strips are put on the web ribbon 2*a* of the web 2** along the lines where later folding of the sheets at a right angle takes place. It is best for the paste used to be a cold-curing dispersion paste, that becomes cured in a short time and has hardly any tendency towards drawing threads, this making it simpler for the paste to be put on the web.

If there are two ribbons to the web, as here, it is only necessary for one of them to be pasted, the other ribbon, in FIG. 1 the ribbon **2*b*, simply bypassing the pasting point, and being so guided that the ribbons come together again and are in register by the time they get to the guide rolls 1. This being so, the distance moved by the two ribbons 2*a* and 2*b* may be equal or the distance may be different by, the length of a sheet cut by the right angle cutter 3. In the present example there are two guide rolls 8 and 9 past which the ribbon 2*b* is trained bypassing the parts of the pasting apparatus next to it. Adjustment of the position of the bend roll 8** is possible for adjustment of register.

The pasting apparatus or unit 7 is made up on the one hand of a pasting cylinder that for its part has cylinder body 11 and, in the present case nested inside same, a paster roll 10, and on the other hand of a web support part 12. The web 2 is moved through between the cylinder body 11 and the web support part 12 used therewith. As will best be seen from FIG. 2, the cylinder body 11 has a hole therein running along parallel to its axis forming a hollow 13, in which the paster roll 10 is fitted. The diameter of the hollow 13 is the same as the outer diameter of the paster roll 10, which may be turned within the hollow. The ends of the hollow 13 are covered over by bearing plates 14 (see FIG. 1) with bearing eyes 15 at the ends of the cylinder body 11, such plates supporting the roll 10 by way of trunnions at the ends thereof; the roll is in the form of shaft body running along the length of the body 11 of the pasting cylinder. The said hollow 13 is placed eccentrically so near to the outer face of the cylinder body that the outline of the cylinder body 11 is cut by the outline of the paster roll 10 so that an axial slot 16 is formed in the outer face of the body 11.

For every length of the sheets to be cut from the web, the cylinder body 11 is turned through 360 deg or a whole multiple thereof. The paster roll 10, nested in the body 11 of the pasting cylinder, is turned in relation to the body 11, this being done in the present case by the use of gearing, more specifically epicylic gearing, at one of the end plates 14, and which is not figured here. By way of such gearing the paster roll 10 is so drivingly joined up with the spur gearing driving the body 11 that the sum of the surface speeds of the paster roll and the cylinder body is equal to the speed of the web 2. Dependent on the diameter of the pasting cylinder body 11 the paster roll 10 may run in the same direction as the body 11 or in the opposite direction thereto. This being so, the cylinder body 11 may be made with a size that is not dependent on the size of the paster roll 10 as measured around same.

The paster roll 10 has at least one paste well 17 in its outer face, that on every turn of the paster roll is topped up or filled with paste and is uncovered as it is moved across the slot 16 so that it may give up its paste to the web, in which respect the web ribbon 2*a* is pressed against the said paster roll 10, whose surface speed is equal to the speed of the ribbon 2*a*. The web support part 12, against which the ribbon 2*a* is rested, is made up a driven shaft 18, on which pinch rail 19, parallel to the paster roll 10 and spaced from the pasting cylinder, is fixed. The pinch rail 19 thereon has a soft elastic pinch pad or bolster pad 20 formed by a rubber band or strip that is keyed or gripped in a groove therefor. The said driven shaft 18 is turned at such a speed as to be in step with the motion of the impositions on the web 2*a*, that is to say it makes one turn every time a length of ribbon 2*a* equal to one sheet is moved past it with the surface speed, as measured at the radially outer edge of the pinch pad 20, equal to the ribbon speed. The working diameter and the speed of the support part 12 may for this reason be said to be equal to the acting diameter and speed of turning of the cutting cylinder 4, that in the present case is to make one turn for each sheet length of the web 2. The shaft 18 of the web support part 12 and the cylinder body 11 are so drivingly joined together, as for example by timing gears, that the pinch pad 20 and or each paste well 17 are kept in step so that on every turn thereof the web ribbon 2*a* is gripped between them (along a line thereon where a right angle fold is to be made) and has a strip of paste put on it, or may be better said to take up the paste from the well 17 more or less automatically, while it (the ribbon 2*a*) is supported on the pinch pad 20 which is so exactly timed that it is at the line on which the ribbon is to be folded at the very same time as the well 17, that is on the other side thereof. The putting on of the paste is in this respect made more efficient in as far as the paste is a dispersion paste with hardly any tendency towards forming threads.

In the present example of the invention the paster roll 10 has a number of paste wells 17 evenly spaced out around and machined into its outer face. For the number of the wells 17 and the distance therebetween the speed of the paster roll 10 in relation to the cylinder body 11 is controlling, and in the present working example the surface speed of cylinder body 11 is to be 9/10 of the web speed and the rest of the web speed, 1/10 thereof, is made up for by turning motion of the paster roll 10 about its own axis in relation to the cylinder body 11. This being so, the paster roll 10 in the present example of the invention has 10 wells 17 that are equally spaced out in the round-the-roll direction: on each and every turn of the cylinder body 11 one of these wells 17 will come to light and be uncovered in the slot 16 running along the length of the said cylinder body 11.

Figure 3:
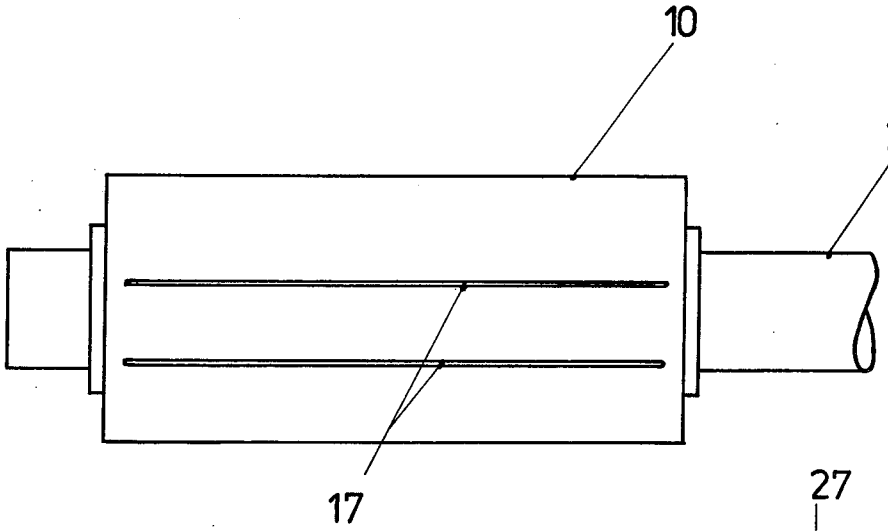
FIG. 3 is a view of the paster roll on a still greater scale.

As may be best seen from FIG. 3, the wells 17 are in the form of grooves, machined parallel to the axis of the paster roll 10, that are limited by their edges in the round-the-roll direction. In the example of the invention in the present case the strips of paste to be printed on them are to be unbroken, that is to say running from one end thereof to the other and not cut up into part-lengths placed end to end. In fact, the grooves forming the paste wells are cut running nearly the full length of the paster roll 10. The width and length of the paste strips put on the web ribbon 2*a* will be dependent on the clearance width and length of the grooves. The length of the grooves forming the paste wells is made somewhat less than the narrowest web on which the apparatus is to be run to make certain that paste is in fact taken out of the wells 17 along the full length thereof without the paster roll 10 having to be changed for narrower webs 2 on makeready. The roll 10, that in the present case has been designed running across the full width of the apparatus, has its trunnions 21 (that are taken up in the bearing eyes 15 as noted earlier in connection with FIG. 1) joined up with part of the said timing gearing. The length of the pasting cylinder body 11 as measured across the web 2 is equal to the overall length of the paster roll 10 together with the trunnions 21. In place of a single-piece paster roll 10 it would furthermore be possible to have a number of short paster rolls placed in a line and end-to-end across the web. And it would furthermore be possible to have each of the paste wells 17 cut up into one or more lengths at one or more points along the length of the paster roll.

For supplying paste to the paster roll 10 there is a paste pocket 22 that is placed roughly diametrically opposite the slot 16 within the body 11. Such supply pocket 22 is walled off on the one side thereof by an inner shoe 23 and on the side opposite by the paster roll 10 itself. The wells 17 in the outer face of the paster roll 10 are moved through the supply pocket 22 because of the turning motion of the roll 10 and so take up paste. The outer face of the roll 10 between the wells 17 is stripped or doctored clear of paste, this ruling out any chance of the outer face picking up dirt. The wells 17 filled with paste are only freed and uncovered on moving into and across the slot 16 and the part of the outer face of the roll 10 that is not in the act of crossing the slot 16 and the paste pocket 22 is kept tightly up against the inner face of the hole 13 in the body 11 because of the fit of these parts, this giving the useful effect of stopping splashing of paste. As the reader will further see on now turning to FIG. 2, the shoe 23 is in the form of a sort of doctor or stripper sliding diametrically in a guideway 24 or opening machined in the body 11, said guideway 24 opening more or less right into the hollow 13. The stripper shoe 23 is in the form of a bar stretching the full length of the paster roll 10 and it has its face next to the roll 10 machined back in the form of a hollow that has the same radius as the roll 10. This inwardly radiussed or concave face of the stripper shoe 23 is pressed against the paster roll 10 by loading springs such as 25 whose ends furthest from the roll 10 are supported on a cover rail 26. It would however be quite possible for the stripper shoe 23 to be kept in position pressed against the paster roll 10 by way of a hydraulic or air powered system in the pasting cylinder body 11 and controlled from some other point on the plant. The paste pocket 22 is limited by an edging strip 27 running around it, the strip being sectioned at two points in FIG. 2. Such edging strip makes certain that the paste wells 17 are filled in the desired way and the outer face of the roll 10 between them is kept clear of paste, the strip 27 furthermore ruling out any chance of the shoe 23 being pushed into and fouling the paste wells 17. The mating faces of the paster roll 10 and the stripper shoe 23 are machined smooth for cutting down wear and have self-lubricating properties for stopping them seizing up if there is no paste between them. In the present working example of the invention the outer face of the paster roll is chromed, while the face of the stripper shoe 23 mating therewith is PTFE-coated or has a cover of such material fixed on it.

Figure 4:
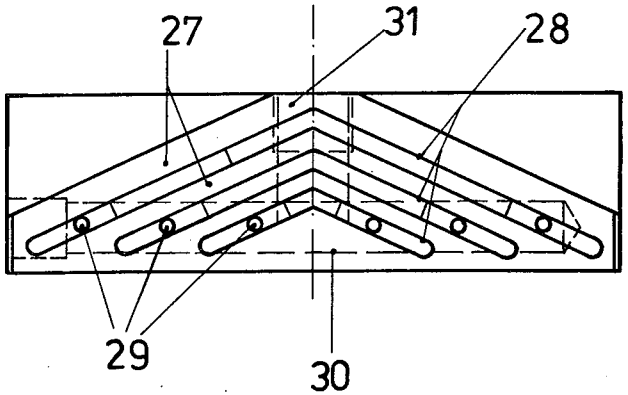
FIG. 4 is a view of a doctor or stripper shoe as seen from the direction of the paster roll.

The paste pocket 22 or store may be in the form of a single-piece hollow or bay. In the present working example in the form to be seen in FIG. 4 however there are a number of chevron-like grooves 28 pointing in the direction of running of the paster roll 10. It is because of this direction and slope of the grooves 28 that the paste is in effect pulled towards the middle of the stripper shoe 23. The chevron-like grooves 28 are supplied with paste from their ends and for this purpose there are inlet holes 29 branching out from a distribution header space 30, that may be in the form of a simple blind hole running along the length of the shoe 23. To get an even distribution of paste along the pocket 22 the branching inlet holes 29 are evenly spaced out along the space 30 and there is a cross hole 31 forming a connection between the space 29 and system of holes 32 which from FIG. 2 may be seen to be formed in the cylinder body 11 and which is at least partly lined up with the hole 31. The system of holes 32, that may be formed by drilling into the material of the body 11, is joined up with a glanded rotary connector at one end of the cylinder body 11 centered on axis of same. From the connector there is a line to a paste pump next to a paste bottle or the like. By supplying the paste with a certain liquid head there is full control of the filling of the wells 17 as a further useful effect.

Although the detailed account hereinbefore is to be thought of as being of one more specially preferred form of the invention, it will be clear that this has not been for limiting the teachings of the invention in any way and, in fact a large number of changes may be made in the form of such apparatus without changing the nature or main ideas of the invention itself in any important respect as looked upon by those versed in the art. It would in fact, as an example of this, be possible for there to be more than one paster roll 10 at the outer face of the cylinder body 11. Furthermore there might be more than one pasting apparatus placed side by side or one after the other. For producing an eight-page section made from two sheets only one pasting apparatus is needed for pasting the one ribbon in strips. With a higher number of ribbons or webs one would then have one further pasting apparatus for each one.

As a further possible step, the place of the stripper shoe 23 might be taken by a stripper knife or doctor blade in the form of a piece of sheet metal. It is in fact more specially in the case of single-piece paste wells without any breaks therein that, if such a blade is used, it would be of value if the blade were placed at a small angle to the axis of the cylinder body 11 or in other words placed helically, to make certain that there would be no chance of the blade's fouling the wells.

We claim:

1. In an apparatus for placing strips of adhesive compound on a web moving in the direction of its length, the strips being generally at a right angle to the said length direction of the web, comprising a pasting cylinder running across said length direction generally at a right angle thereto, means for turning said cylinder at a speed related to the speed of said web, and a support part, said support part and said pasting cylinder being on opposite sides of said web, the invention residing in that said pasting cylinder is made up of a paster roll and a pasting cylinder body with said roll thereon, the roll and the cylinder having axes that are parallel to each other, said roll being supported on said body for turning motion in relation thereto and having an outer face with at least one paste well let into it so that said well is open and in the form of a break in the said outer face, said well having an outer limiting edge in keeping with the desired form of said strips, stripper means for keeping said outer face clear of said compound, said outer face being uncovered at least at a position opposite to said web support part, driving and timing means for turning said pasting cylinder body and said paster roll in relation to each other so that the axis of one thereof is moved about the other and so that the roll and the body is each turned about its axis with the timing thereof bearing a relation to the speed of the said web and being such that the sum of the surface speeds of the roll and of the said body as measured in the direction of motion of said web is equal to the speed of the web, said support part comprising a shaft, means for turning said shaft in timed relation to said web and to said paster roll, and a rail fixed to said shaft and sticking out proud therefrom in a radial direction in relation thereto, said rail being parallel to said pasting cylinder.

2. The apparatus as claimed in claim 1 wherein said paster roll is nested within a hollow in said body, said hollow being eccentric in relation to said body, said body having a slot in an outer face thereof uncovering the said outer face of said roll with said well therein, said slot being parallel to the said axis of said body.

3. The apparatus as claimed in claim 1 comprising bearings at two ends of said body for supporting said paster roll at two ends thereof, said paster roll stretching generally along the complete length of said body.

4. The apparatus as claimed in claim 1 wherein said well is in the form of a groove in the outer face of said paster roll, said groove being parallel to the axis of the paster roll and shorter in length than the narrowest width of web on which said apparatus is able to be run.

5. The apparatus as claimed in claim 1 wherein said paster roll has at least two such wells spaced evenly in its outer face in the round-the-roll direction.

6. The apparatus as claimed in claim 1 wherein said gearing joining said roll to said body is toothed gearing.

7. The apparatus as claimed in claim 7 wherein said gearing is epicylic gearing.

8. The apparatus as claimed in claim 1 wherein said stripper means is made up of a stripper shoe guided in a guideway in said body for generally radial motion in relation thereto, said shoe mating with said outer face of said paster roll over a limited area thereof, said shoe comprising an edging strip round an edge thereof, said edging strip forming limits of an adhesive compound pocket between a face, turned towards said roll, of said shoe and the said outer face of said roll within said area, said apparatus further having an adhesive compound supply means for forwarding such compound into said pocket.

9. The apparatus as claimed in claim 8 having at least two such adhesive compound pockets that as viewed looking radially towards the shoe from the direction of the roll are chevron-like and pointing in the direction of turning of said roll, said pockets being formed by grooves.

10. The apparatus as claimed in claim 9 having a system of at least one header space in said shoe for the distribution and inlet of said compound to said wells.

11. The apparatus as claimed in claim 9 having an inlet hole placed generally halfway between ends of said shoe, these said ends being at ends of said body, said inlet hole overlapping a hole in said body at one end of a system of holes in said said body, said apparatus further having a rotary connector at one end of said body and a supply vessel for such compound, said vessel being joined with said system of holes in said body by said rotary connector.

12. The apparatus as claimed in claim 8 having a fluid power system for keeping said stripper shoe up against said outer face of said roll.

13. The apparatus as claimed in claim 8 wherein said shoe and said roll have running faces touching each other, at least one of said running faces being designed for running free of seizure while dry.

14. The apparatus as claimed in claim 1 wherein said rail for supporting said web has a soft elastic material pad or bolster thereon, said apparatus further comprising timing and driving gearing for turning said shaft and said rail thereon at a speed such that the pad is moved at an effective speed equal to the speed of said web.

15. The apparatus as claimed in claim 1 having a stripper blade running helically along said roll.

16. In combination with the apparatus as claimed in claim 1 a right angle cutter and a right angle folder designed for folding said web after being cut down into sheets by said cutter, said web being in the form of two ribbons with printed impositions, thereon said combination comprising bypass guide means for training one of said ribbons clear of said apparatus while another of said ribbons is guided therethrough between said web support part and said pasting cylinder, and means for guiding said two ribbons together again at a point downstream from said apparatus so that said impositions are in register with each.

17. The combination of the said cutter, the said folder and the said apparatus as claimed in claim 17 wherein said cutter has a cutter cylinder with an acting radius equal to the acting radius of the said rail.

* * * * *